United States Patent [19]

Schrooten

[11] Patent Number: 4,834,099

[45] Date of Patent: May 30, 1989

[54] ORTHODONTIC FEEDING NIPPLE

[75] Inventor: Rik Schrooten, Peer/Kleine Brogel, Belgium

[73] Assignee: Helvoet Pharma N.V., Alken, Belgium

[21] Appl. No.: 44,841

[22] PCT Filed: Aug. 28, 1986

[86] PCT No.: PCT/EP86/00503

§ 371 Date: Jun. 29, 1987

§ 102(e) Date: Jun. 29, 1987

[87] PCT Pub. No.: WO87/01277

PCT Pub. Date: Mar. 12, 1987

[30] Foreign Application Priority Data

Aug. 29, 1985 [DE] Fed. Rep. of Germany ..... 3530911

[51] Int. Cl.[4] ..... A61J 17/00; A61J 13/00; A61J 9/00

[52] U.S. Cl. ..... 128/360; 128/360; 215/11.1

[58] Field of Search ..... 128/360, 359, 150; 215/11.1

[56] References Cited

U.S. PATENT DOCUMENTS

| | | | |
|---|---|---|---|
| 2,520,773 | 8/1950 | Muller | 128/360 |
| 3,022,915 | 2/1962 | Mullin | 128/360 |
| 3,082,770 | 3/1963 | Straub | 215/11.1 |
| 3,092,276 | 6/1963 | Schaar | 215/11.1 |
| 3,777,753 | 12/1973 | Kesselring | 215/11.1 |
| 4,381,785 | 5/1983 | Robbins | 128/359 |
| 4,403,613 | 9/1983 | Panicci | 128/359 |
| 4,676,386 | 6/1987 | Phlaphongphanich | 128/360 |

FOREIGN PATENT DOCUMENTS

| | | |
|---|---|---|
| 8524734 | 4/1986 | Fed. Rep. of Germany . |
| 2066795 | 7/1981 | United Kingdom . |
| 2181957 | 5/1987 | United Kingdom . |

*Primary Examiner*—Robert A. Hafer
*Assistant Examiner*—Michael Brown
*Attorney, Agent, or Firm*—Spencer & Frank

[57] ABSTRACT

The feeding nipple contains an annular connecting part the outer face of which defines a base plane and a central longitudinal axis perpendicular thereto, as well as a hemispherical shell and a hollow nozzle portion, integrally formed onto it via a narrowed neck part, having a suction opening in its rounded tip. All components form a one-piece hollow body of an elastomeric material which is mirror-symmetrical with respect to a plane of symmetry containing the longitudinal axis. A plane of division, perpendicular to the plane of symmetry and axially dividing the hollow nozzle portion in a longitudinal direction intersects the longitudinal axis near the base plane and is spaced apart from it at the apex of the rounded tip by approximately 6 mm. The hollow nozzle portion, including the neck part is limited on the inside by ellipses parallel to the base plane, the minor axes of which are located in the plane of symmetry, and all points of the ellipses are located within a reference intersection curve at the narrowest outer cross section of the neck at a minimum distance of 0.5 mm. The hollow nozzle portion includes a thickened region, the maximum value of which is located for approximately half of its length in the plane of symmetry. The feeding nipple can be produced economically and in a shape optimized for pressure molding (injection molding).

14 Claims, 3 Drawing Sheets

ORTHODONTIC FEEDING NIPPLE

BACKGROUND OF THE INVENTION

1. Field of the Invention

The invention relates to an orthodontic feeding nipple, comprising a one-piece, single-walled hollow body of elastomeric material including an annular connecting part for attaching it to a feeding bottle disposed coaxially to a longitudinal axis. The feeding nipple is placed with its outer face in a first base plane perpendicular to this longitudinal axis. The feeding nipple includes a shell in the form of a body generated by revolution, its longitudinal axis forming its axis, having the approximate shape of half a hollow sphere, its edge integrally formed onto the other face of the connecting part and having an opening in the area facing away from the base plane; and a hollow nozzle portion closed at its free end by a rounded tip. The hollow nozzle portion has a narrowed neck part at its other end, the wall thickness of which in a reference plane parallel to the base plane and drawn through the point of its smallest outside diameter is in general equal across its entire circumference and is integrally formed onto the opening of the shell. The entire hollow body is mirror-symmetrical with respect to a plane of symmetry passing through the longitudinal axis and the axis of a bore of a suction opening extending through the wall of the hollow nozzle portion. The vertex of the outer surface of the hollow nozzle portion furthest away from the base plane is located on a vertex line perpendicular to the plane of symmetry and offset from the longitudinal axis, and the inner surface intersection curves, created by the intersection of the inner surface of the hollow nozzle portion with arbitrary transverse planes parallel to the base plane, have approximately the form of ellipses, the minor axes of which form the intersection lines of the plane of symmetry with the respectively associated transverse planes.

2. Discussion of the Prior Art

Known feeding nipples of this type are produced by the dipping process which, on the one hand, is expensive as a manufacturing process and, on the other hand, only permits the formation of all the walls with a generally equal wall thickness. To the extent that for medical reasons it would be required to provide sections of the feeding nipple with an enlarged wall thickness, these limitations have to be tolerated.

Compared with the formation after normal development, the lower jaw of a child is in a recessed position at birth and the palate has a comparatively compressed shape.

During natural feeding by the mother, the child presses the mother's nipple against its palate by means of the tongue and stimulates the discharge of milk by a pulsating pressure of the tongue on the nipple which, because of its shape and tissue structure, passes on these pressure pulses to the palate. The latter reacts to this by growing. The pressure pulses also act on the lower jaw and continuously force it forward. The lower jaw reacts by slowly shifting its position forward. The tongue movements described are basically always performed by the child when it is awake; however, they are especially pronounced during feeding, thus giving it special importance for a good formation of the body parts described above. It has already been a goal in feeding nipples of the type described above to achieve effects in the development of children comparable to breast feeding without, however, being able to approach this goal to the extent desired.

SUMMARY OF THE INVENTION

It is the object of the invention to improve a feeding nipple of the type described above in its construction such that it can be produced more economically and that it insures by its use an optimal development of the palate and the lower jaw as well as the required suction capability.

This object is attained by means of the invention in that the inner surface of the hollow nozzle portion, including its rounded tip and a section of its neck portion extending to the reference plane, is formed such that every point of all of the inner surface intersection curves, when projected parallel to the longitudinal axis onto the reference plane, is located within the reference intersection curve formed by the intersection of the outer surface of the hollow nozzle portion with the reference plane and maintains a distance of at least 0.5 mm from it; that a reference line located in the reference plane, being perpendicular to the plane of symmetry and axially dividing the reference intersection curve is offset by from 2.3 to 3.3 mm from the longitudinal axis in the same direction as the vertex line; that the first wall section of the hollow nozzle portion being on the one side of a plane of division drawn through the vertex line and the reference line and containing the intersection point of the reference plane with the longitudinal axis generally having an even wall thickness corresponding to the wall thickness in the reference plane; and that the second wall section, located on the other side of the plane of division, has a wall thickness continuously tending toward a maximal value with increasing approach towards a centrally located point, where this maximal value is equal to a 1.5 to 3 times the wall thickness in the reference plane.

This design makes it possible to produce the feeding Enipple are achieved in addition to the shaping of the outer surface.

The offset of the reference lines means that the hollow nozzle portion not only extends at an angle to the shell, as in a mere offsetting of the vertex line, but that also its connecting point with the shell is offset from the center. Together with the shell being encompassed by the lips of the child, this provides sufficient free space for the tongue located under the hollow nozzle portion. The thin first wall part of the hollow nozzle portion (oriented toward the tongue or the lower jaw) does not present undesirably great resistance to the pressure or suction movements of the tongue that assure the discharge of the fluid by means of the feeding nipple, and the child is encouraged to continue the required tongue movements. The thicker second wall part of the hollow nozzle portion oriented towards the palate insures that the correct position in the mouth, i.e. against the palate and extending far into the mouth, is actually achieved.

Further features and advantages of the invention will become evident from the dependent claims.

BRIEF DESCRIPTION OF THE DRAWINGS

An exemplary embodiment of the invention is described below by means of the drawings, in which.

DESCRIPTION OF THE PREFERRED EMBODIMENT

Figure 1:
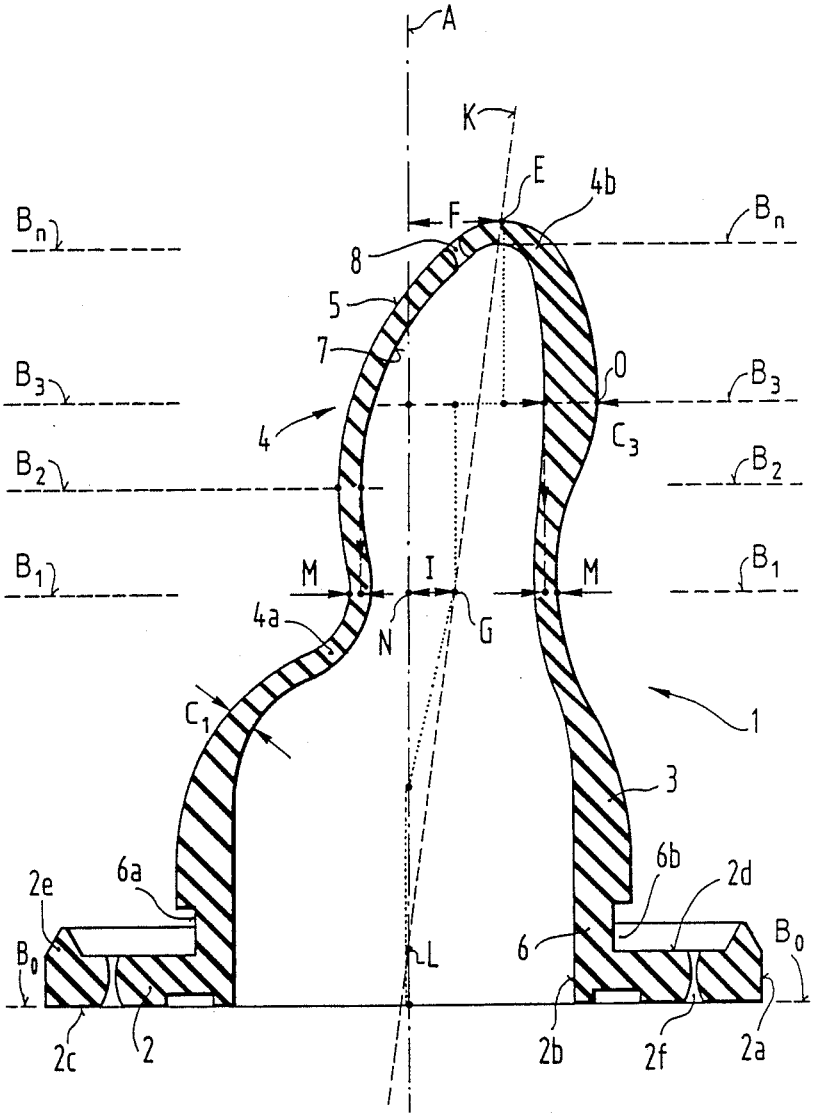
FIG. 1 is a longitudinal section through the feeding nipple presented in its plane of symmetry.

The feeding nipple is formed by a one-piece hollow body of an elastomeric material, for example rubber of silicone, made by pressure molding and is generally designated by reference numeral 1. This hollow body mainly consists of a connecting part 2, a shell 3 and a hollow nozzle portion 4 with a neck part 4*a*.

The connecting part 2 is designed for attachment to a drinking bottle and has the general shape of an annular disc. The outer cylindrical peripheral surface 2*a* and the inner cylindrical surface (bore) 2*b* of are disposed coaxially with a longitudinal axis A. The outer face 2*c*, oriented away from the remaining parts of the feeding nipple, forms a contact surface contacting the front edge of the mouth of the drinking bottle during use of the feeding nipple and is placed in a base plane $B_0$ which is perpendicular to the longitudinal axis A. Adjoining the outer peripheral surface 2*a* an annular bead 2*e*, of triangular cross section, extends from the other, inner end face 2*d*. Radially within this annular bead 2*e*, several air supply bores 2*f* extend through the connecting part.

The shell 3 has approximately the shape of a hollow half sphere, the wall thickness $C_1$ of which diminishes, beginning with a maximal size in the area of its base, with increasing approach to the longitudinal axis A. The shell 3 is disposed coaxially with the longitudinal axis A and is connected with the connecting part 2 via a collar 6, the diameters of the inner peripheral surfaces of these three components being of the same size and the outer peripheral surface 6*a* of the collar 6 having a smaller diameter than the shell 3 at its base, so that an annular slit 6*b*, radially open toward the outside, is created. Opposite its base, the shell 3 has an opening that is disposed offset with respect to the longitudinal axis A, in a plane of symmetry (which corresponds to the drawing plane of FIG. 1) that contains this longitudinal axis A.

The hollow nozzle portion 4 is affixed with its neck part 4*a* to this opening such that a continuous transition exists at the outer surface 5 and the inner surface 7 of the hollow body 1. The neck part 4*a* has an inwardly directed curve such that its inner surface 7 forms a throat between the inner chambers encompassed by the shell 3 and the hollow nozzle portion 4, while its outer surface forms a constriction which is most pronounced in the plane of symmetry and has its smallest value in a plane that is perpendicular to this plane of symmetry and contains the longitudinal axis A. On its free end, the hollow nozzle portion is closed with a rounded tip 4*b*.

Figure 4:
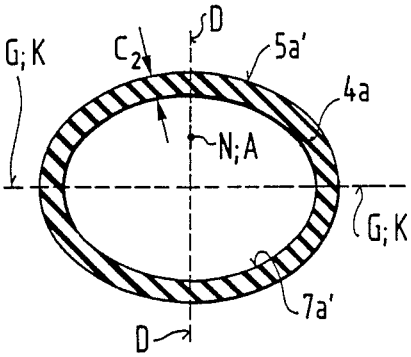
FIG. 4 is a cross section of the feeding nipple taken through the reference plane $B_1$ of FIG. 1.
Figure 5:
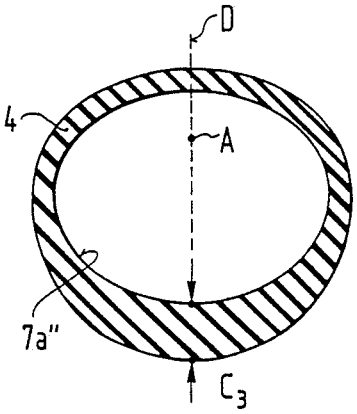
FIG. 5 is a cross section of the feeding nipple taken through the reference plane $B_3$ of FIG. 1.

The intersection curves (FIGS. 4 and 5) forming the outer surface 5 or the inner surface 7 of the hollow nozzle portion 4, including its neck part 4*a*, by intersection of planes parallel to the base plane $B_0$ are at least approximately in the form of ellipses, the minor axes of which lie in the plane of symmetry D. The greatest approximation to the elliptical form occurs with the inner surface intersection curves as well as with the outer surface intersection curves of the neck part 4*a*. In the following, that plane parallel to the base plane $B_0$ is designated as reference plane $B_1$ which runs through the neck part 4*a* at the place of its smallest outside diameter and the thus created outer surface intersection curve as reference intersection curve 5'*a* (see FIG. 4). In this reference plane $B_1$, the neck part 4*a* has a wall thickness $C_2$, which is constant over its entire periphery, between the inner surface intersection curve 7'*a* and the reference intersection curve 5'*a*.

The hollow nozzle portion 4 is disposed offset and slanted on the shell 3 such that its vertex most remote from the base plane $B_0$ is located on the outer surface 5 of a vertex line E, which is perpendicular to the plane of symmetry D, and which has an offset F in regard to the longitudinal axis A, the value of which lies in the range of 5.5 to 6.5 mm. Furthermore, a reference line G axially dividing the reference intersection 5'*a* (i.e. in its elliptical form it forms its large axis) has an offset J in regard to the longitudinal axis A extending in the same direction as the offset F, being smaller than the latter and having a value in the range of 2.3 to 3.3 mm. The offset J has been selected such that a plane of division K, containing the vertex line E and the reference line G, intersects the longitudinal axis A at a point L, which adjoins the base plane $B_0$. In preferred embodiments the values for the offset F are in the range of 5.9 to 6.0 mm and for the offset J in the range of 2.6 to 3.0 mm.

The inner surface 7 of the hollow nozzle portion 4, including its neck part 4*a*, is designed such that all points of the inner surface intersection curves 7'*a*, 7''*a* for transverse planes $B_2$–$B_4$, which are parallel to the base plane $B_0$, located between the reference plane $B_1$ and a transverse plane $B_n$, tangential to the vertex of the inner surface 7, in their projection parallel to the longitudinal axis A onto the reference plane $B_1$ are located inside the reference intersection curve 5'*a*. These projected points further satisfying the condition that their distance M from the reference intersection curve 5'*a* be at least 0.5 mm.

The plane of division K divides the hollow nozzle portion 4, including its neck part 4*a* and its rounded tip 4*b*, into two wall sections. The first wall section, located on that side of the plane of division K containing the intersection point N of the reference plane $B_1$ with the longitudinal axis A, has a wall thickness equal to the wall thickness $C_2$ of the neck part 4*a* in the reference plane $B_1$. The second wall section, located on the other side of the plane of division K also has, adjacent to the plane of division K, a wall thickness $C_2$ which continuously increases up to a centrally located point O and there has a maximum value $C_3$ which is equal to 1.5 to 3 times the wall thickness $C_2$ in the reference plane $b_1$. This point O is located in the intersection of the plane of symmetry D with a transverse plane $B_3$ which is parallel to the base plane $B_0$ and which is located approximately in the center between the reference plane $B_1$ and the vertex line E. In the same transverse plane $B_3$, the inner surface 7 has its greatest distance from the longitudinal axis A in the plane of symmetry D. In a transverse plane $B_2$, located approximately in the center between the transverse plane $B_3$ and the reference plane $B_1$ and which is parallel to the base plane $B_0$, the inner surface 7 of the first wall section has the greatest distance from the longitudinal axis A in the plane of symmetry D.

Figure 2:
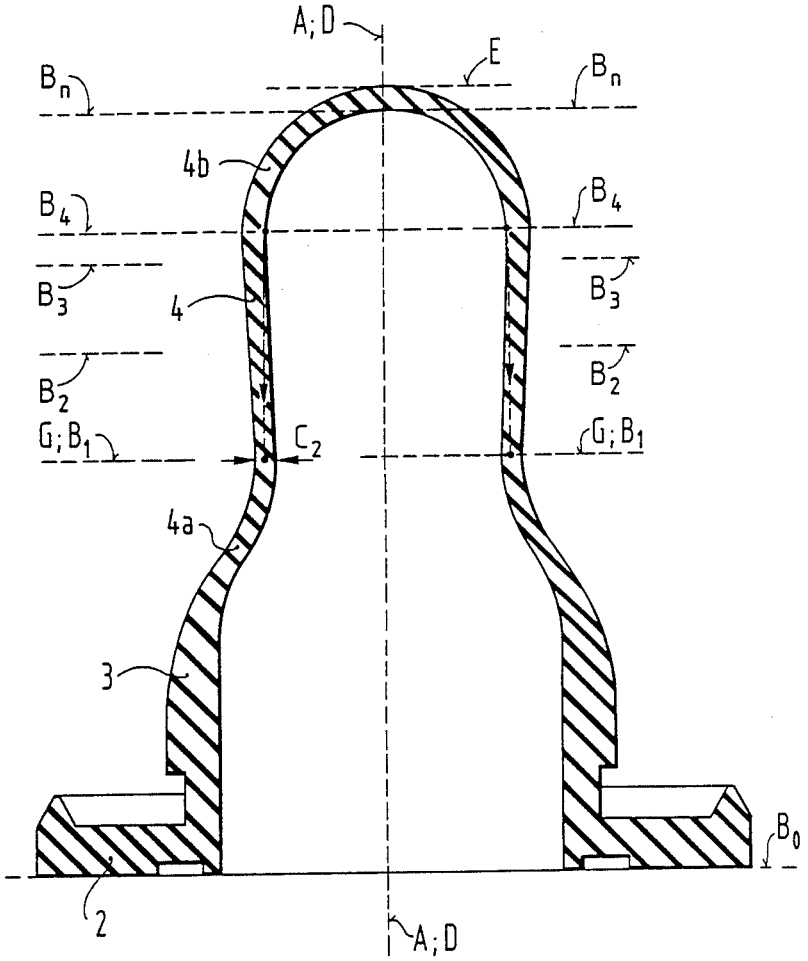
FIG. 2 is a longitudinal section through the feeding nipple presented in intersection planes turned by 90° in regard to FIG. 1 acccording to the broken line shown in FIG. 1.
Figure 3:
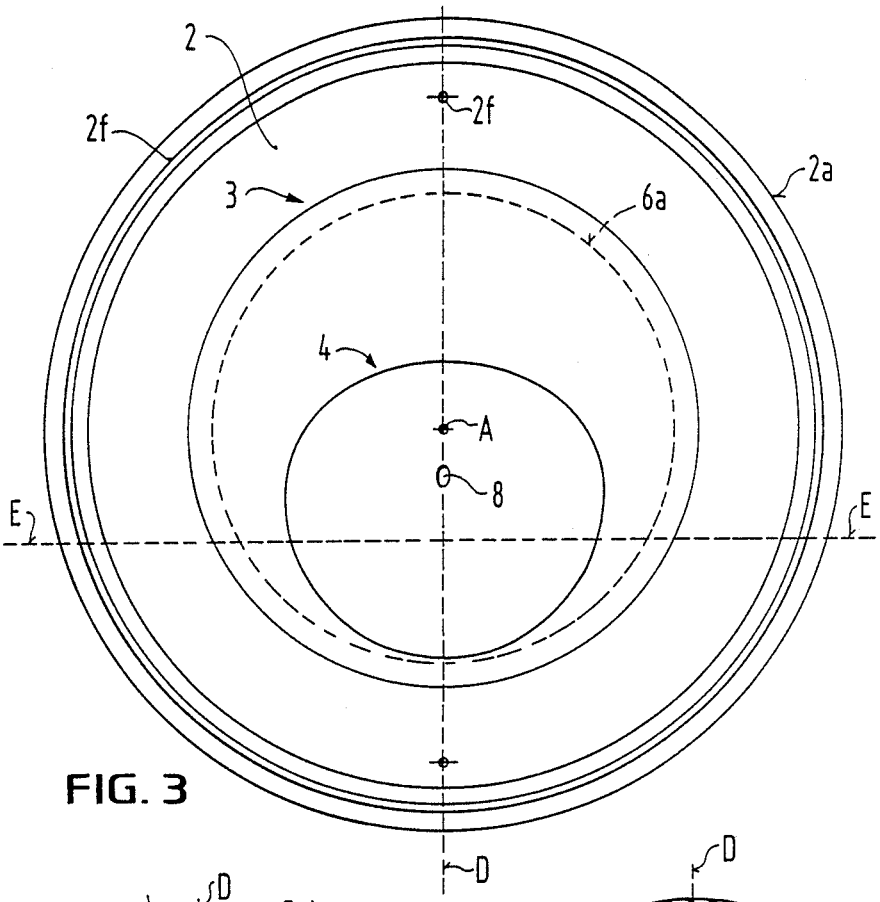
FIG. 3 is a top view of the feeding nipple.

The inner and outer breadth of the hollow nozzle portion 4, measured at an intersection line between the plane of division K and a transverse plane parallel to the base plane $B_0$, is greatest in that transverse plane $B_4$ (FIG. 2), which is located between the transverse planes $B_n$ and $B_3$ and lies very close to the latter transverse plane. The breadth increases, mainly proportionally to the distance from this reference plane, to the maximum value mentioned before, beginning with a minimum value in the reference plane $B_1$.

The maximum width of the hollow nozzle portion 4, measured between parallel planes tangential to the outer surfaces 5 and respectively perpendicular to the plane of symmetry D and parallel to the plane of division K, with respect to the length of the hollow nozzle portion 4, measured between the reference line G and the vertex line E, is at a ratio within the range of 0.75:1 to 0.85:1 and advantageously within the narrower range of 0.78:1 to 0.82:1. The ratio of maximum width to maximum breadth is within the range of 0.83:1 to 0.93:1, the narrower range of 0.85:1 to 0.90:1 being preferred.

A suction opening 8 is located in the plane of symmetry D at a point offset with regard to the vertex (vertex line E) of the hollow nozzle portion 4 on the previously defined one side of the plane of division K. Two (or more) suction openings can be provided in the wall of the hollow nozzle portion 4 on both sides of the plane of symmetry D and it is also possible to have the suction opening(s) be made by the user. In this case there can also be a marking or weakening of the wall of the hollow nozzle portion 4 at the place provided for the suction opening 8.

It is claimed:

1. An orthodontic feeding nipple adapted for attachment to a feeding bottle, comprising:

a one-piece, single-walled hollow body of elastomeric material and having a longitudinal axis, including:

an annular connecting part adapted for attachment to the feeding bottle, said annular connecting part having an inner face and an outer face, with said outer face being disposed in a base plane perpendicular to the longitudinal axis;

a shell portion having a form of a body generated by revolution and being approximately hemispherically shaped, said shell portion including a first end integrally connected to said inner face of said annular connecting part and having a second end disposed from said base plane, said shell portion forming an opening for the passage of liquid therein;

a hollow nozzle portion having a first end which is closed by a rounded tip and a second end including a narrowed neck part which is integrally connected to said second end of said shell portion, said second end of said hollow nozzle portion having a substantially constant cross section around its circumference in a region having the smallest outer diameter, said region being further defined as being taken in a reference plane that is parallel to said base plane, said hollow nozzle portion forming a continuation of the opening formed by said shell portion for the passage of liquid therein; and wherein said hollow body is mirror-symmetrical with respect to a plane of symmetry passing through the longitudinal axis;

said rounded tip includes a point which is disposed further away from said base plane than all the remaining material of said hollow nozzle portion and said point is offset from the longitudinal axis of said body;

said hollow nozzle portion includes an inner surface contoured such that all transverse planes which are parallel to said base plane from said reference plane to an inner surface of said rounded tip are substantially in the shape of an ellipse which has a minor axis located along the plane of symmetry;

the elliptical shapes of the inner surface which are formed by the transverse planes parallel to said base plane between said reference plane and said rounded tip are sized such that when the ellipses are projected parallel to the longitudinal axis onto said reference plane, the ellipses are located at least 0.5 mm within an ellipse formed by the outer surface in said reference plane;

a reference line located in said reference plane and perpendicular to said plane of symmetry centrally divides the ellipse formed by the outer surface in said reference plane, said reference line is offset between 2.3 to 3.3 mm from the longitudinal axis of said body in the same direction that said point of said rounded tip is offset from the longitudinal axis;

a plane of division which divides said hollow nozzle portion into a first wall section and a second wall section, said plane of division is disposed through said point of said rounded tip and said reference line, the first wall section has a substantially constant cross section equal to the wall thickness of said hollow nozzle portion in said reference plane; and the second wall section has a wall thickness continuously increasing from said point of said rounded tip to a centrally located point between said point of said rounded tip and said neck part of said hollow nozzle portion, the wall thickness at said centrally located point of said second wall section being 1.5 to 3 times the wall thickness in said reference plane.

2. An orthodontic feeding nipple as defined in claim 1, wherein said plane of division intersects the longitudinal axis at a point adjacent said base plane.

3. An orthodontic feeding nipple as defined in claim 1, wherein said plane of division extends parallel to the longitudinal axis.

4. An orthodontic feeding nipple as defined in claim 1, wherein the maximum value of the wall thickness of said hollow nozzle portion is located at the intersection of said plane of symmetry and a first transverse plane which is disposed parallel to said base plane, the first transverse plane being located approximately in the center between said reference plane and said point of said rounded tip.

5. An orthodontic feeding nipple as defined in claim 1, wherein a point of said first wall section of said hollow nozzle portion that is located in said plane of symmetry and at a maximum distance from the longitudinal axis is located in a second transverse plane which is closer to said reference plane than the transverse plane containing the point the maximum wall thickness.

6. An orthodontic feeding nipple as defined in claim 1, wherein the ratio between the maximum width of said hollow nozzle portion, which is measured between planes that are tangential to said outer surface, parallel to said plane of division and perpendicular to said plane of symmetry, with respect to the length of said hollow nozzle portion, which is measured between said reference line and said point of said rounded tip, is within the range of 0.75:1 to 0.85 to 1.

7. An orthodontic feeding nipple as defined in claim 1, wherein said point of said rounded tip is offset from the longitudinal axis in the range of 5.5 to 6.5 mm.

8. An orthodontic feeding nipple as defined in claim 1, further comprising a suction opening extending through said first wall section of said hollow nozzle portion.

9. An orthodontic feeding nipple as defined in claim 1, wherein the wall thickness of said shell portion has a maximum value adjacent said annular connecting part and the wall thickness of said shell portion decreases steadily until it is equal to the wall thickness at said reference plane.

10. An orthodontic feeding nipple as defined in claim 1, wherein the maximum value of the wall thickness of said hollow nozzle portion is located at the intersection of said plane of symmetry and a first transverse plane which is disposed parallel to said base plane and is positioned at a location where the inner surface of said second wall section is at a maximum distance from the longitudinal axis.

11. An orthodontic feeding nipple as defined in claim 10, wherein a point of said first wall section of said hollow nozzle portion that is located in said plane of symmetry and at a maximum distance from the longitudinal axis is located in a second transverse plane which is approximately in the center between said first transverse plane and said reference plane.

12. An orthodontic feeding nipple as defined in claim 1, wherein the breadth of said hollow nozzle portion, which is measured along the lines of intersection between said plane of division and transverse planes parallel to said base plane, increases on the preponderant part of the length of said hollow nozzle portion proportional to the distance from said reference plane.

13. An orthodontic feeding nipple as defined in claim 12, wherein the breadth of said hollow nozzle portion, which is measured along the lines of intersection between said plane of division and transverse planes parallel to said base plane, increases on the preponderant part of the length of said hollow nozzle portion proportional to the distance from said reference plane up to a location having a maximum breadth, and wherein the ratio of the maximum width to the maximum breadth is in the range of 0.83:1 to 0.93:1.

14. An orthodontic feeding nipple as defined in claim 13, wherein the ratio of the maximum width to the length of said hollow nozzle portion is 0.78:1 and the ratio of the maximum width to the maximum breadth of the hollow nozzle portion is in the range of 0.85:1 to 0.9:1 and said point of said rounded tip is offset from said longitudinal axis in the range of 5.0 to 6.0 mm and said reference line is offset from said longitudinal axis in the range of 2.6 to 3.0 mm.

* * * * *